US007849550B2

(12) United States Patent
Lanz et al.

(10) Patent No.: US 7,849,550 B2
(45) Date of Patent: Dec. 14, 2010

(54) SWIVEL PAINT ROLLER APPARATUS

(76) Inventors: Donald D. Lanz, 15657 S. Neibur Rd., Oregon City, OR (US) 97045-9060; Scott M. Lanz, 15657 S. Neibur Rd., Oregon City, OR (US) 97045-9060

( * ) Notice: Subject to any disclaimer, the term of this patent is extended or adjusted under 35 U.S.C. 154(b) by 1040 days.

(21) Appl. No.: 11/472,053

(22) Filed: Jun. 20, 2006

(65) Prior Publication Data

US 2007/0000083 A1 Jan. 4, 2007

Related U.S. Application Data

(60) Provisional application No. 60/695,599, filed on Jun. 30, 2005.

(51) Int. Cl.
*B05C 17/02* (2006.01)

(52) U.S. Cl. ..... 15/230.1; 15/144.1; 492/13; 492/19

(58) Field of Classification Search ..... 15/230.11, 15/144.1, 144.2; 492/13, 19
See application file for complete search history.

(56) References Cited

U.S. PATENT DOCUMENTS 5,207,755 A * 5/1993 Ampian ..... 15/230.11
5,903,952 A 5/1999 Camp, Jr. et al.
6,128,800 A * 10/2000 Vosbikian ..... 15/172

* cited by examiner

*Primary Examiner*—Shay L Karls
(74) *Attorney, Agent, or Firm*—Schwabe, Williamson & Wyatt, P.C.

(57) ABSTRACT

A swivel paint roller apparatus is arranged for mounting on an extension pole member and arranged to provide for rotation of the roller frame about a pivot axis oriented angularly in the range of 20 degrees to 80 degrees relative to the axis of a longitudinal extension of the base mount supporting the roller frame member, for swiveling, rotating movement of the roller frame and paint roller cage and cover supported thereon by rotation of the extension pole member held in the hands of a user during painting operations, thereby providing for the variation of the angular orientation and corresponding direction of travel of the paint roller during painting operations while permitting the paint roller to remain continuously in contact with the surface being painted, whereby to enhance and simplify painting operations when using an extension pole.

21 Claims, 3 Drawing Sheets

SWIVEL PAINT ROLLER APPARATUS

This application claims benefit under 35 U.S.C. 119(e) of the priority filing date of U.S. Provisional application Ser. No. 60/695,599; filed 30 Jun. 2005.

BACKGROUND OF THE INVENTION

This invention relates generally to paint rollers, and more particularly to paint rollers arranged to support the paint roller frame assembly for rotation on a supporting base of the paint roller arranged for mounting connection onto the end of an extension pole member.

Paint rollers have long been used for painting large, flat, expansive areas such as walls, floors and ceilings and when held in the hand of an operator, provide the user with great versatility in such painting operations. Specifically, rollers may be moved over the surface being painted in straight, vertical and horizontal directions of travel as well as arcuate directions of travel movement, without need of lifting the roller from the surface being painted, by normal and natural articulation of the wrist and arm, as is well known.

However, as is also well known, paint rollers are frequently used on the ends of extension pole members in order to provide greater reach of the painting operation without need of the operator standing on ladders or step stools, etc. However, as is well understood in the art, when paint rollers are mounted on the end of longitudinally elongated extension pole members, the aforementioned versatility of the painting operation offered by the articulation of the wrist and arm of the operator is entirely lost, and painting operations are typically then restricted to vertically extending directions of movement between which the roller is typically lifted off of the surface being painted for lateral movement of the assembly and placement back onto the surface for another vertical painting operation. Since the paint roller apparatus is mounted at the end of a long extension pole member, any arcuate travel of the roller requires wide angling of the long extension pole member or movement of the operator about the floor surface to accomplish angling of the roller for travel during painting. As will be appreciated by those skilled in the painting industries, when a roller is moved upwardly along a wall to a point near the juncture of the wall with the ceiling, upward travel is stopped and the roller lifted and moved to the left or right in order to paint another vertical stretch. This stopping and lifting the roller and replacing it on the surface being painted typically leaves a pooling of paint on the surface and requires follow-up detail painting with a brush to smooth out the pooling and to finish painting the wall surface to its juncture with the ceiling, as is understood.

U.S. Pat. No. 5,903,952 discloses an indexable paint roller frame arrangement that is supported rotatably on a roller handle member for indexing of the roller cage and cover of the roller to several different positions to permit the paint roller to reach difficult faces and angles of a painting surface identified as such things as railings, cabinets, pipes, trim and the like. In this regard, the indexable paint roller arrangement provides for indexed rotating movement of the roller cover on a plane that is spaced perpendicularly from and extends parallel to the longitudinal axis of the handle of the paint roller. This arrangement is generally similar, in terms identifiable to the layman, to the overall appearance and relationship of a helicopter main rotor rotating above the body of the helicopter.

Given the earlier discussed limitations imposed on paint rollers when mounted on the end of longitudinally elongated extension pole members, it is evident that a benefit would be derived by the provision of a paint roller apparatus which is arranged to generally simulate the general painting orientations achieved by the articulations of the wrist and arm when the paint roller is supported on the extension pole during painting operations.

SUMMARY OF THE INVENTION

In its basic concept, this invention provides a swiveling paint roller apparatus arranged for mounting on the end of a longitudinally extending extension pole for rotation of the roller cage-mounting roller frame assembly about an axis of rotation that extends at a predetermined, selected acute included angle of between 20 degrees to 80 degrees relative to the longitudinal axis line of extension of the base mount member supporting the roller frame, for swiveling movement of the roller cage on a plane disposed angularly forwardly of and intercepted by the longitudinal axis of extension of the supporting base mount member and an extension pole mounting the base mount member, in order to permit roller painting operations with an extension pole that substantially simulates paint roller operation afforded by hand and arm articulation movements when paint rollers are held in the hand of an operator.

It is by virtue of the foregoing basic concept that the principal object of this invention is achieved; namely, the provision of a swivel paint roller for use on extension poles and arranged to permit continuous rolling contact of the roller cover with a surface being painted in different directions of linear and arcuate travel of the roller over the surface, whereby to overcome the limitations and disadvantages of conventional extension pole-mounted paint rollers and their capabilities in painting operations provided heretofore.

Another object of this invention is the provision of a swiveling paint roller apparatus of the class described in which the rotational swiveling of the roller frame may selectively be substantially unrestricted or adjustably tensioned, whereby to selectively control the force required to effect swiveling of the paint roller on the end of an extension pole during painting operations.

Another object of this invention is the provision of a swivel paint roller apparatus of the class described in which the swiveling roller frame may if desired be releasably locked in selected positions of rotational orientation and against swiveling movement on its supporting base for substantially fixed, conventional use of the paint roller apparatus.

Another object of this invention is the provision of a swivel paint roller apparatus of the class described which provides the painter with more flexibility and mobility in roller painting operations using extension poles, including the ability to continuously roll in opposite directions involving compound angles and curves by simple twisting of the extension pole held in hand, giving the painter a broader range of painting from a single position or ladder placement, and further allowing the operator to "steer" around windows, doors and corners not normally possible with an extension pole-mounted conventional roller.

A further object and advantage of this invention is the provision of a swivel paint roller apparatus of the class described which is of simplified construction for economical manufacture and reliability of operation.

The foregoing and other objects and advantages of the present invention will appear from the following detailed description, taken in connection with the accompanying drawings of a preferred embodiment.

DESCRIPTION OF THE PREFERRED EMBODIMENT

Figures 1, 4, 5:
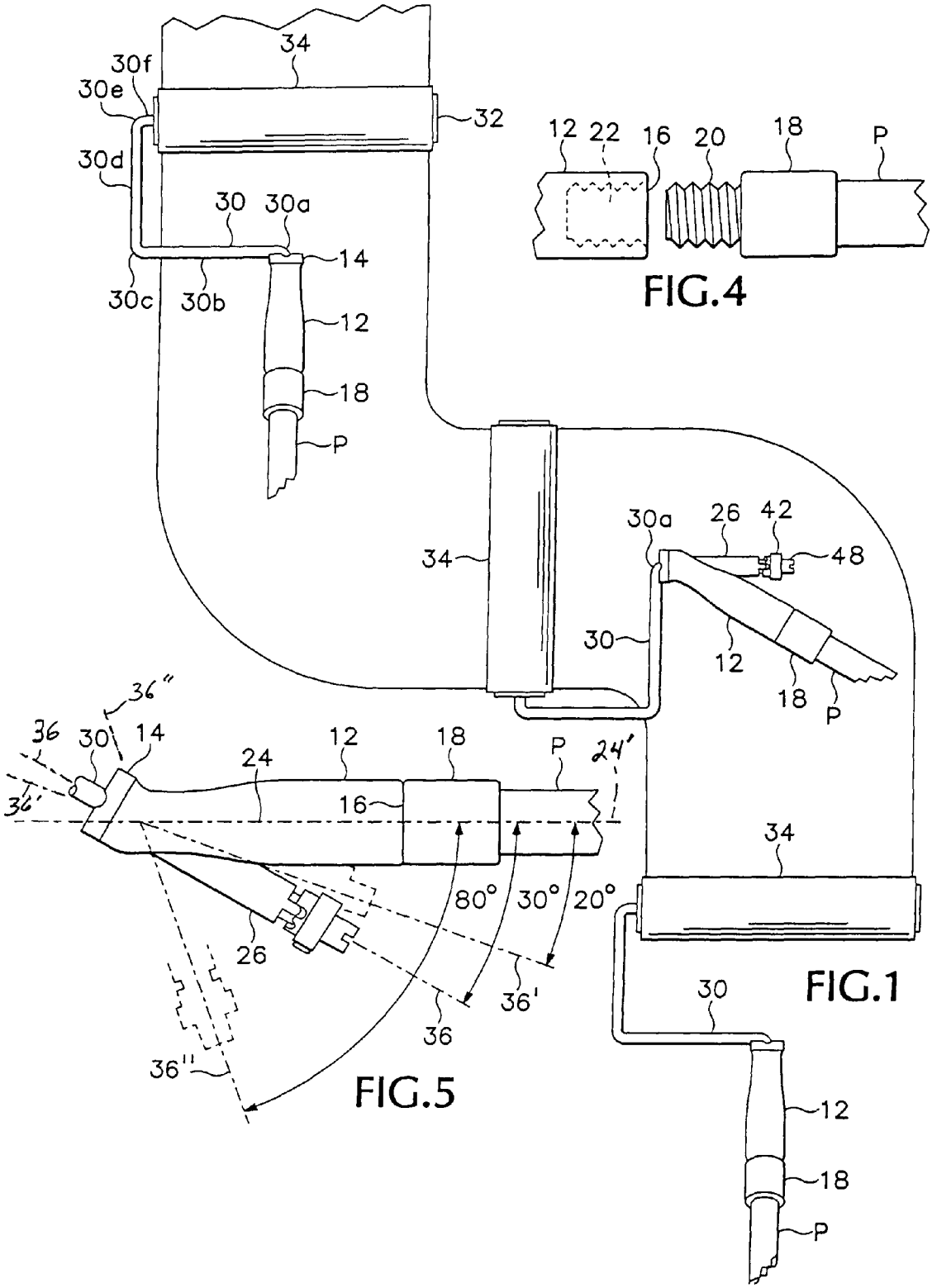
FIG. 1 is a fragmentary vertical elevational view illustrating a swivel paint roller apparatus embodying features of this invention mounted on the end of an elongated extension pole member and showing operational capabilities of the roller apparatus during a painting operation.
FIG. 4 is a fragmentary side elevational view illustrating one arrangement for mounting the base mount member of the swivel roller apparatus onto an extension pole.
FIG. 5 is a fragmentary side elevational view of the base mount member and roller frame rod mount body.
Figures 2, 3:
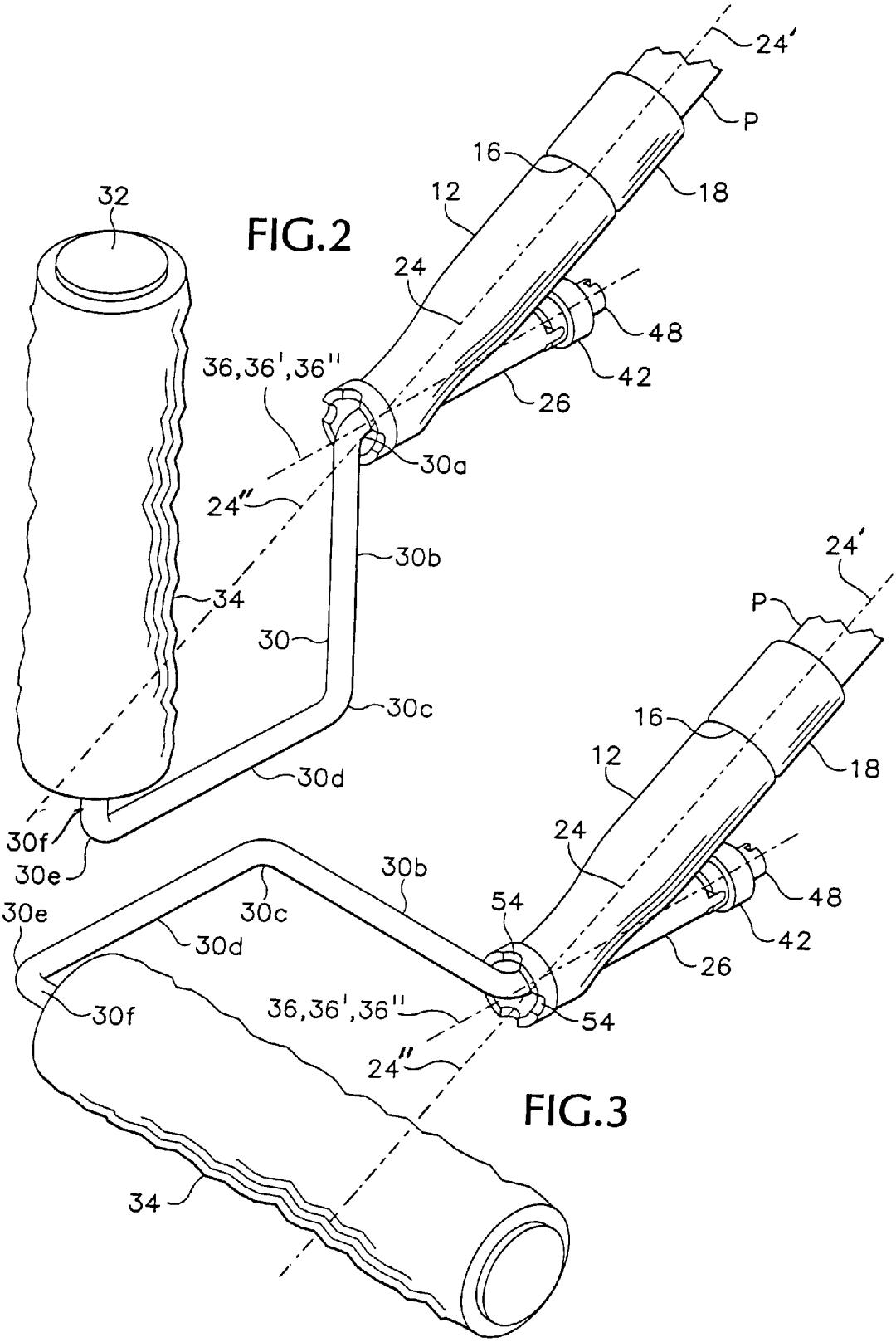
FIG. 2 is a fragmentary top front perspective view of the swivel roller apparatus showing the roller frame in one position of rotational swivel on the base mount member.
FIG. 3 is a fragmentary top front perspective view similar to that of FIG. 2 but showing the roller frame in another position of rotational swivel 90 degrees relative to that shown in FIG. 2.

The earlier-mentioned and other objects and advantages of the swivel paint roller apparatus of this invention are accomplished by the provision of a paint roller assembly 10 as illustrated in FIGS. 1, 2 and 3 of the drawings. As shown, the roller apparatus embodied herein comprises generally a base mount member 12 illustrated herein as a longitudinally elongated member terminating in opposite longitudinal first, front and second, rear terminal ends 14, 16 respectively and defining therebetween a longitudinal axis line of extension 24 of the longitudinally extending base mount member. As seen best in FIG. 4, the base mount member 12 is arranged for releasable mounting connection to a tool mount member 18 secured on the terminal end of a conventional extension pole member P. These longitudinally elongated extension poles extend linearly along a longitudinal axis line of extension as is well understood in the painting industry.

Many different types and forms of tool mount members have been provided heretofore for securing various painting and other tools releasably onto the mounting end of extension pole members. In this regard, the base mounting member 12 may be arranged as desired for mounting interconnection with any type of such extension pole tool mount. For purposes of illustration in this regard, and as shown best in FIG. 4, the base mount member 12 of this invention is shown herein as being arranged for mounting connection to an extension pole tool mount 18 having a forwardly projecting threaded mounting shaft 20, as is a well known mount in this art. In this, the second, rear terminal end 16 of the base mount member 12 includes an internal, threaded bore 22 configured for threaded reception of the threaded shaft 20 for securing the base member 12 onto the mounting end of the extension pole member P, for mounted extension of the base member 12 on the elongated extension pole P with parallel alignment of the longitudinal axis lines of extension 24, 24' of the extension pole P and base mount member 12, respectively. In this regard it is to be understood that although in the illustrated arrangement the base member 12 is mounted on an extension pole in a manner in which the longitudinal lines of extension 24, 24', respectively, are parallel and aligned, they may alternatively be arranged to extend in parallel but non-aligned, spaced apart condition as may be required in different base member configurations and mounting arrangements for connecting the base mount member to an extension pole.

As also seen in FIG. 5, the base member 12 includes, adjacent its opposite, first, front longitudinal end 14, a paint roller frame mount body 26 having, in the illustrated embodiment, a centrally disposed, longitudinal bore 28, 28' (FIG. 6) therethrough configured to receive the rear mounting end portion 30' of a paint roller frame 30 for rotation of the inner, mounting end portion 30' of the roller frame within the bore 28, 28' of the mount body 26. As is known in rod-type paint roller frame constructions such as the one illustrated herein, the roller frame member 30 typically includes a substantially right angle bend 30*a* where the frame rod exits the conventional handle (in the present invention, the base member 12) of a paint roller, forming a first frame rod length 30*b* extending substantially perpendicularly to the line of extension of the frame rod end section 30'. A second substantially right angle bend 30*c* defines a second frame rod length 30*d* extending forwardly substantially parallel to the line of extension of the frame rod end portion 30', and a third right angle bend 30*e* defines a final, third rod length 30*f*, defining the front end portion of the roller frame which is configured to rotatably support a conventional paint roller cage 32 which in turn supports an overlying paint roller cover 34, as is well understood in the paint roller industry. As can be seen, the projecting rod forming the rear mounting end portion 30' of the illustrated roller frame extends substantially perpendicularly to and substantially centrally relative to the roller cage and cover supported on the front end of the roller frame.

Critical to the present invention, as shown in the drawings and illustrated specifically in FIG. 5, is the paint roller frame rod mount body 26 and the particular angular orientation of its longitudinal bore 28, 28' (FIG. 6) for rotatably supporting the rear end portion 30' of the paint roller frame rod angularly relative to the longitudinal axis line 24 of extension of the base mount member 12 and to the associated axis line 24' of extension of an extension pole P when secured thereto. In this regard, FIG. 5 shows in broken lines that the longitudinal centerline axis of extension 36, 36' 36" of the bore 28, 28' is oriented angularly relative to the longitudinal line of extension 24 of the base mount member 12 specifically at an acute, rearwardly-inclined angle within the range of between 20 degrees (line 36') and 80 degrees (line 36"), and as illustrated in the embodiment illustrated herein, preferably approximately 30 degrees (line 36). As will also be appreciated in viewing FIG. 5, the opposite, forwardly-inclined obtuse angle relationship corresponding to the axis lines of extension 36, 36', 36" reflects a range of between 160 degrees (lines 36') and 100 degrees (line 36") and preferably approximately 150 degrees (line 30).

This angular axis of rotation arrangement provides for rotation of the roller frame 30, roller cage 32 and roller cover 34 combination about the axis of inner frame rod end 30' rotating within the bore 28, 28' for swiveling, rotating movement of the roller frame, cage and cover assembly on a plane that is disposed forwardly of the front end 14 of the base mount member 12 and intersected angularly by an imaginary line 24" (FIGS. 2 and 3) representing the forward extension of longitudinal line 24 of extension through the base mount member 12.

Figure 6:
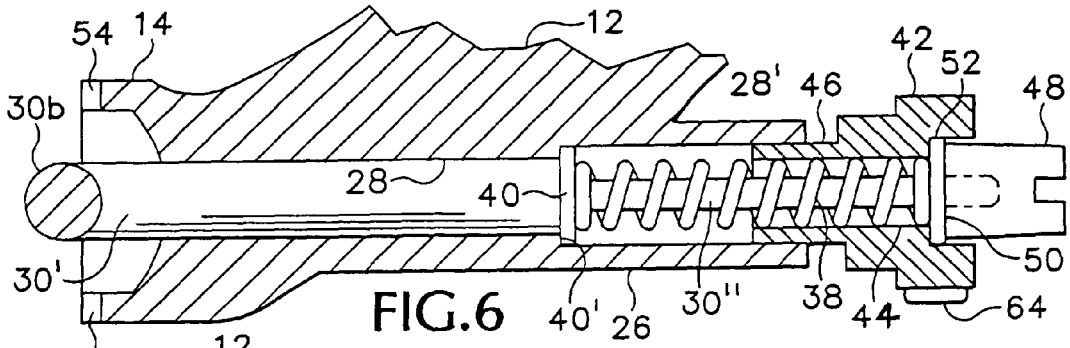
FIG. 6 is a fragmentary sectional view through the roller frame mount body showing internal detail.
Figure 7:
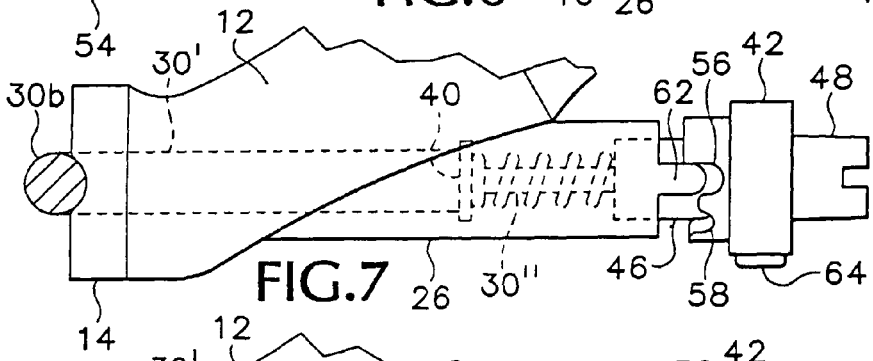
FIG. 7 is a fragmentary side elevational view of the roller frame mount body of FIG. 6 but in a slightly reduced scale and showing the spring tensioning and locking arrangement in a first position of adjustment, broken lines showing internal detail otherwise hidden from view.
Figure 7A:
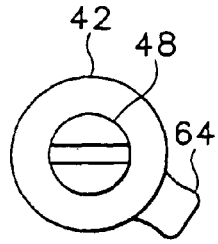
FIG. 7*a* is an end view of the end guide member and spring tension cap in the first position of adjustment of the assembly of FIG. 7.
Figure 8:
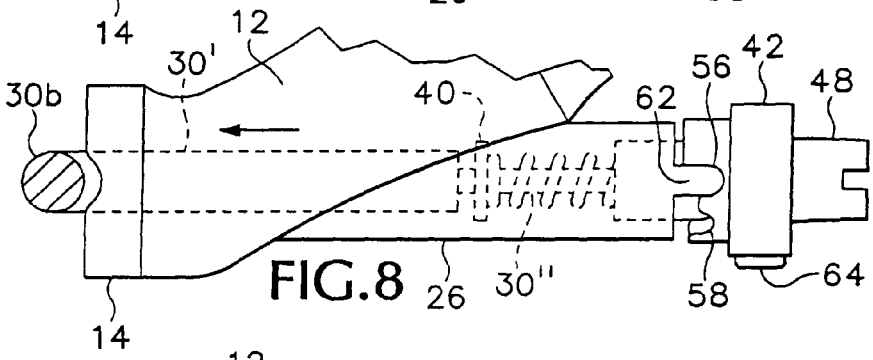
FIG. 8 is a side elevational view similar to FIG. 7 but showing the roller frame rod end portion moved outwardly against its spring tensioned support in the mount body for swiveling movement of the roller frame.
Figure 8A:
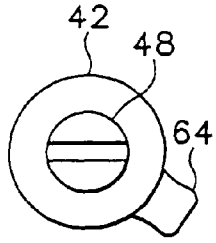
FIG. 8*a* is an end view of the end guide member and spring tension cap corresponding to the position of the apparatus in FIG. 8.
Figure 9:
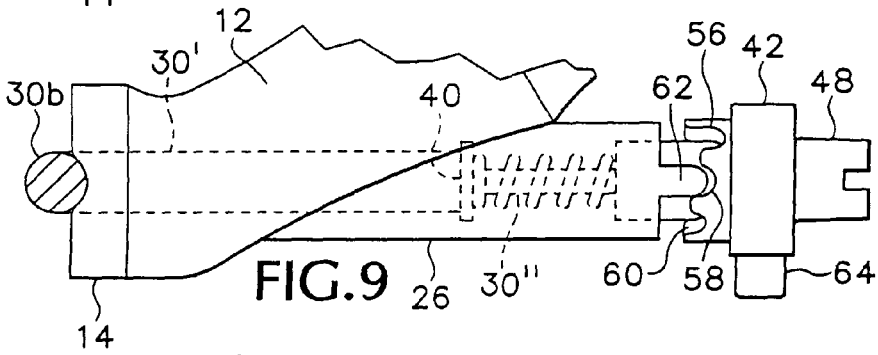
FIG. 9 is a side elevational view similar to FIG. 7 but showing the end guide member rotated to a second position arranged to provide a second, increased spring tension against the roller frame.
Figure 9A:
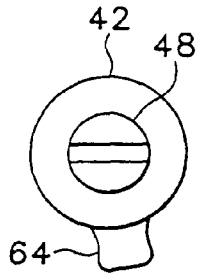
FIG. 9*a* is an end view of the end guide member and spring tension cap corresponding to the position of the assembly of FIG. 9.

As shown best in FIG. 6, in the particular embodiment illustrated herein the rear terminal end portion 30' of the roller frame rod 30 is supported rotatably in longitudinal slot 28 which, in this embodiment, includes a rear end portion 28' of slightly increased diameter than is the diameter of the forward portion 28. The rear end portion 30' of the roller frame rod 30 is configured in this embodiment with the forward portion having a diameter slightly smaller than the bore portion 28 and with a rearmost, threaded shaft portion 30" having a reduced diameter. As shown in FIG. 6, a coil type tension spring 38 is positioned to overly and encircle the threaded shaft portion 30", the spring contained within the larger diameter bore 28', the spring having a forward terminal end arranged to abut a stop washer 40 engaging a landing surface 40', such as that formed at the juncture of the larger diameter bore portion 28' with the smaller diameter bore portion 28 within the frame rod mount body 26.

In the particular embodiment illustrated, an end guide member 42 includes an internal, longitudinally extending bore 44 therethrough arranged for free reception of the threaded rod end portion 30" and overlying tension spring 38 as shown in FIGS. 6-10*a*. The guide member also forms a forwardly projecting, tubular guide sleeve member 46 having an external diameter configured for sliding reception within the longitudinal bore portion 28' of the rod mount body member 26.

An internally threaded end screw cap member 48 is provided to threadably engage the threaded end portion 30" of the inner end 30' of the frame rod member 30 as seen clearly in FIG. 6. The end cap member 48 abuts the rear terminal end of the tension spring 38, and a stop washer 50 is arranged to engage a recessed stop landing 52 associated with the longitudinal bore 44 through the guide member 42 as shown. In this manner, the inner end 30', 30" portions of the roller frame rod 30 are captured rotatably in the longitudinal bore 28, 28' of the frame rod mount body 26 by abutment of the end screw cap member 48 with the stop landing 52 adjacent the rear terminal end of the inner portion of the frame rod and at the opposite forward end of the frame rod inner end portion by abutment of the frame rod length portion 30*b* formed at the right angle bend 30*a* against the forward terminal end 14 of the frame rod mount body 26, as is clearly seen in FIGS. 2, 3 and 6.

As will also be readily understood in FIG. 6 of the drawings, the rearward tension supplied by spring 38 engaging at its opposite terminal ends the fixed landing surface 40' and the threaded end cap member 48, may be adjusted as desired by rotation of the adjustment end cap 48 as is apparent. By turning the adjustment end cap 48 in the direction to thread the cap further on to the threaded end 30" of the frame rod, the spring 38 is compressed, thereby increasing the frictional, tensioned abutment of the frame rod portion 30*b* against the front terminal end 14 of the body 12. Reverse rotation of the end cap 48 moves the cap rearwardly on the threaded portion 30" of the rod, thereby reducing the compression of the spring 38 and in turn reducing the amount of tension with which the rod portion 30*b* abuttingly engages the front end 14.

As shown, the front end 14 may, if desired be provided with one or more annularly spaced frame rod seats 54 arranged to provide selected, positive stop points of rotation of the roller frame rod 30 relative to the base mount 12. Such frame rod seats may be provided in the form of shallow depressions as shown, or in any other suitable, alternative configuration as may be desired including shallow grooves, notches, surface knurling, or other forms of stops. Clearly with such rod seats provided and with the frictional abutment tension of the rod 30*b* against the front end 14 adjusted by end cap screw 48 adjustment of the spring tension as previously explained, and with the frame rod length 30*b* engaged by a rod seat 54, the rotational orientation of the roller frame and cover relative to the base mount body 12 will be maintained until and unless the relative rotational force therebetween exceeds the selected spring tension force, as is readily apparent to those skilled in the art.

From the foregoing therefore it is apparent that the purpose and operation of this invention is to provide an operator with more flexibility and mobility when a using a paint roller on the end of an extension pole. Typically, when an operator uses a conventional paint roller mounted on the end of an extension pole, he must paint in linear strokes, and loses the ability to paint compound angles and to turn and to manipulate the direction of the roller as can be done by virtue of wrist, elbow and shoulder functions when the paint roller is being held directly in the operators hand.

The swiveling paint roller apparatus thus described and illustrated herein thus effectively simulates the wrist and arm articulation movements, etc. of a hand-held paint roller to re-orient the roller and direction of roller movement by providing a swivel paint roller on the end of an extension pole that can change angles and directions of movement by simply twisting or rotating the extension pole member P held in the operators hands as the painting operation is being done, as is clearly reflected in the illustration of FIG. 1 of the drawings. This gives the operator a broader range of painting from a single position or ladder placement because of the variable compound angles achieved by the roller cage and cover while maintained in continuous, moving contact with the surface being painted. This allows the operator to "steer" around windows, doors and corners not normally possible with a conventional paint roller on an extension pole, thus giving the operator the flexibility of a hand operated paint roller but in fact one mounted on the end of an extension pole.

As previously mentioned, the swivel tension is adjustable as desired by adjustment cap screw 48 in order to adjust a set degree of pressure against the painting surface that is required to change the angle or rotational positioning of the roller by twisting movement of the extension pole member. This swiveling or angle changing effect, by twisting the extension pole, is possible because of the difference in the plane in which the roller frame is rotating relative to the longitudinal axis on which the extension pole is being rotatably twisted. That difference of angle determines the degree of angle change.

In this regard, the lesser the angle, for example the 20 degree angle represented by center line 36', the less and slower the angular change of the roller cage and roller cover against the work surface. The greater the angle difference, for example the 80 degree angle indicated by centerline 36", the greater and more rapid the angle change. As indicated previously the optimum angle difference is approximately 30 degrees, but angular positioning of the frame rod body mount 26 of between 20 degrees to not more than 80 degrees is considered satisfactory.

FIGS. 7-10*a* illustrate that the previously described structural arrangement of FIG. 6 may, if desired, be further arranged to provide for both the swiveling function of the paint roller apparatus thus desired, and, selectively, the locking of the roller frame in a fixed position of rotational orientation for use of the paint roller apparatus of this invention as a non-swiveling, conventional paint roller on the end of an extension pole member P if desired. In this regard, the end guide member 42 is further arranged for rotational movement received within the longitudinal bore portion 28' of the rod mount body member 26 and is further configured with detents or notches 56, 58, 60 arranged for communication with a projecting tab member 62 projecting rearwardly from the rear end of the rod mount body member 26 as shown.

Figure 10:
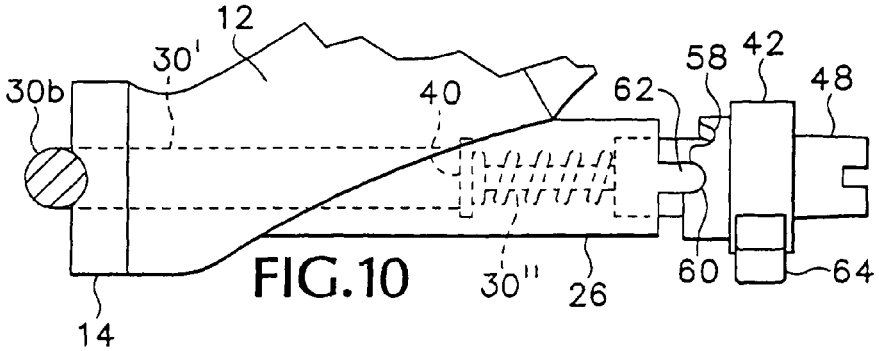
FIG. 10 is a side elevational view similar to FIG. 7 but showing the end guide member rotated to a third, locking position securing the roller frame against swiveling rotation on the base mount.
Figure 10A:
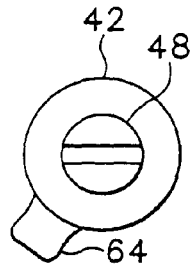
FIG. 10*a* is an end elevational view of the end guide member and spring tension cap corresponding to the position of the assembly shown in FIG. 10.

As illustrated the notches are arranged with selected, declining depth wherein the depth of notch 56 is arranged to permit longitudinal movement of the frame rod sufficient for the frame rod section 30*b* to fully and freely move out of a seat 54 with minimal tension supplied by the preset tension of the tension spring 38. Notch 60 is arranged with a shallow depth which, as shown in FIG. 10, when engaged by a tab 62 prevents longitudinal movement of the frame rod and effectively locks the assembly in a seated condition in which the frame rod length portion 30*b* is captured within a seat 54, thereby locking the assembly in a fixed condition similar to a conventional paint roller.

An intermediate notch 58 may be provided with an intermediate depth selected for abutment with tab 62 allowing for sufficient movement of the rod within the rod mount body to permit movement of the rod length portion 30*b* to move close enough to separation from the rod seat 54 with a slightly increased amount of force required to overcome the preadjusted spring tension set by the adjustment end cap 48. To facilitate identification of the rotational orientation of the end guide member and the aforementioned positioning of the respective notches 56, 58, 60 relative to the tab 62, a finger tab 64, seen best in FIGS. 7*a*-10*a* may be provided as shown.

The operation and operational features of the swivel paint roller apparatus of this invention are well understood in viewing FIG. 1 of the drawings. In this regard, with the swivel paint roller apparatus 10 mounted on the end of an extension pole member P, a single downward, continuous stroke of the roller is shown. As the roller is moved vertically downwardly from the position shown at the top left in FIG. 1, the swivel roller may be reoriented by simply twisting the extension pole member, in this example, counterclockwise. This counterclockwise rotation or twisting of the pole with the roller maintained continuously in contact with the surface being painted causes the assembly 10 to swivel into the position shown in the middle of FIG. 1 wherein the roller cage and cover has been oriented for movement in a horizontal line of travel. Rotation of the extension pole member clockwise effects swiveling operation of the paint roller back into the vertical orientation of travel shown at the lower right in FIG. 1. Clearly, other angles or arcuate travel of the paint roller over the surface may be accomplished by lesser amount of twisting on the extension pole. Clockwise and counterclockwise rotation of the extension pole in both forward and rearward strokes will obviously effect swiveling of the paint roller for travel in virtually any direction and angle as may be desired, substantially similarly to a hand-held paint roller.

From the foregoing it will be apparent to those skilled in the art that the invention thus described provides a swiveling paint roller apparatus that is arranged to provide a paint roller for use on the end of an elongated extension pole yet arranged to substantially duplicate the movements thereon that are otherwise only achievable by a paint roller being held directly in the hand of its operator. From the foregoing it will also be readily apparent to those skilled in the art that various changes, other than those already described may be made in the size, shape, type, number and arrangement of parts described hereinbefore without departing from the spirit of this invention and the scope of the appended claims. As an example, the longitudinally elongated base mount member may be configured if desired for convenient grasping in the hand of a user, for normal hand-held operation when the assembly is locked in the position of FIG. 3 against rotation of the roller frame assembly, thereby providing a paint roller capable of conventional hand-held operation as well as operation on an extension pole member and capable of simulating hand-held capabilities as described hereinbefore.

Having this described our invention and the manner in which it may be used, we claim:

1. A swivel paint roller apparatus, comprising:

a) a longitudinally extending base mount member having a longitudinal axis of extension and opposite front and rear longitudinal terminal ends, b) a paint roller frame member having a first, front end portion mounting a rotatable roller cage and cover member and a second, rear, mounting end portion arranged for mounting the paint roller frame member rotatably on the front end of the base mount member, c) a paint roller frame mount member on said base mount member, a front end of the paint roller frame mount member being adjacent said front end of the base mount member, and arranged to mount said roller frame member on said front end of the base mount member for rotation of the paint roller frame member about an axis of rotation on a line extending angularly relative to said longitudinal axis of extension of the base mount member at a selected, acute included angle within the range of 20 degrees to 80 degrees, d) lock means for interengaging said roller frame mount member and said rear, mounting end portion of said paint roller frame member for releasably locking said paint roller frame member in selected positions of rotation on the base mount member, said locking means comprising a guide member rotatable between a first position that permits said paint roller frame member to rotate about said axis of rotation, and a second position that substantially locks said paint roller frame in a selected position of rotation on the base mount member; and e) whereby rotation of the roller frame member on its mount on the base mount member rotates the roller cage and cover on the front end portion of the roller frame member on a plane disposed forwardly of the front end of the base mount member and intercepted by an imaginary line extending forwardly from said longitudinal axis of extension of the base mount member.

2. The swivel paint roller apparatus of claim 1 wherein said axis of rotation of the roller frame extends on a line extending angularly approximately 30 degrees relative to said longitudinal axis of extension of the base mount member.

3. The swivel paint roller apparatus of claim 1 including spring tension means interengaging said roller frame mount member and said rear, mounting end portion of the paint roller frame member for adjustably tensioning a resistance force applied against rotation of the paint roller frame member on the roller frame mount member.

4. The swivel paint roller apparatus of claim 1 wherein said rear, mounting end portion of said paint roller frame member is formed as a rearwardly extending rod and said roller frame mount member includes an internal bore arranged to receive said rod rotatably therein for supporting the paint roller frame member rotatably on the roller frame mount member.

5. The swivel paint roller apparatus of claim 1, wherein the paint roller frame member, the roller frame mount member, and the base mount member are arranged for rotation of the paint roller frame member about the axis of rotation on the line extending angularly relative to said longitudinal axis of extension of the base mount member at a selected, acute included angle within the range of 20 degrees to 80 degrees by rotating the base mount member about said longitudinal axis of extension.

6. A swivel paint roller apparatus, comprising:

a) a longitudinally extending base mount member having a longitudinal axis of extension and opposite front and rear longitudinal terminal ends, b) a paint roller frame member having a first, front end portion mounting a rotatable roller cage and cover member and a second, rear, mounting end portion arranged for mounting the paint roller frame member rotatably on the base mount member, c) a paint roller frame mount member on said base mount member adjacent said front end thereof and arranged to mount said roller frame on the base mount member for rotation of the paint roller frame about an axis of rotation on a line extending angularly relative to said longitudinal axis of extension of the base mount member at a selected, acute included angle within the range of 20 degrees to 80 degrees, and d) lock means for interengaging said roller frame mount member and said rear, mounting end portion of said paint roller frame member for releasably locking said paint roller frame member in selected positions of rotation on the base mount member, said locking means comprising a guide member rotatable between a first position that permits said paint roller frame to rotate about said axis of rotation, and a second position that substantially locks said paint roller frame in a selected position of rotation on the base mount member;

e) wherein rotation of the roller frame member on its mount on the base mount member rotates the roller cage and cover on the front end portion of the roller frame member on a plane disposed forwardly of the front end of the base mount member and intercepted by an imaginary line extending forwardly from said longitudinal axis of extension of the base mount member; and wherein said guide member includes a first detent member having a first depth and a second detent member having a second depth that is less than said first depth, and said lock means further comprises a tab member on said paint roller frame mount member for selectively engaging said first and second detent members.

7. The swivel paint roller apparatus of claim 6 wherein when said guide member is rotated to said first position said tab member engages said first detent member, and when said guide member is rotated to said second position said tab member engages said second detent member.

8. A paint roller, comprising:

a base member having a longitudinal axis of extension and opposite front and rear longitudinal terminal ends, a mount on the base member and having a front end adjacent to the front end of the base member, a roller frame having a first end for rotatably mounting a roller cage and a second end for rotatably mounting the roller frame to the front end of the mount for rotation of the roller frame about a rotational axis, and a lock for releasably locking the roller frame in selected positions of rotation about the rotational axis, wherein the lock includes a locking member rotatable between a first position that permits the roller frame to rotate about the rotational axis, and a second position that locks the roller frame in a selected position of rotation about the rotational axis, wherein the longitudinal axis of extension is the same as the rotational axis of the roller frame.

9. The paint roller of claim 8, including a spring tension assembly interengaging the mount and the second end of the roller frame for adjustably tensioning a resistance force applied against rotation of the roller frame about the rotational axis.

10. The paint roller of claim 9, wherein the spring tension assembly includes a rotatable adjustment member that, when rotated, adjusts the resistance force applied by the spring tension assembly against rotation of the roller frame.

11. The paint roller of claim 8, wherein the base member has a longitudinal axis, and the rotational axis of the roller frame extends at an angle within the range of 20 degrees to 80 degrees relative to the longitudinal axis of the base member.

12. The paint roller of claim 8 wherein the rotational axis of the roller frame extends at an approximately 30 degree angle relative to the longitudinal axis of the base member.

13. The paint roller of claim 8, wherein rotation of the roller frame about the rotational axis causes the roller cage to rotate within a plane that intersects the longitudinal axis of the base member.

14. A paint roller of, comprising:

a base member, a mount on the base member, a roller frame having a first end for rotatably mounting a roller cage and a second end for rotatably mounting the roller frame to the mount for rotation of the roller frame about a rotational axis, and a lock for releasably locking the roller frame in selected positions of rotation about the rotational axis, wherein the lock includes a locking member rotatable between a first position that permits the roller frame to rotate about the rotational axis, and a second position that locks the roller frame in a selected position of rotation about the rotational axis;

wherein the locking member includes a first detent having a first depth and a second detent having a second depth that is less than the first depth, and the lock further comprises a tab on the mount for selectively engaging the first and second detent members upon rotation of the locking means between the first and second positions.

15. The paint roller of claim 14, wherein when the locking member is rotated to the first position the tab engages the first detent, and when the locking member is rotated to the second position the tab engages the second detent.

16. A paint roller, comprising:

a base member having a longitudinal axis of extension and opposite front and rear longitudinal terminal ends, a mount on the base member and having a front end adjacent to the front end of the base member, a roller frame having a first end for rotatably mounting a roller cage and a second end for rotatably mounting the roller frame to the front end the mount for rotation of the roller frame about a rotational axis, and a spring tension assembly interengaging the mount and the second end of the roller frame for adjustably tensioning a resistance force applied against rotation of the roller frame about the rotational axis, wherein the spring tension assembly includes a rotatable adjustment member that, when rotated, adjusts the resistance force applied by the spring tension assembly against rotation of the roller frame, wherein the longitudinal axis of extension is the same as the rotational axis of the roller frame.

17. The paint roller of claim 16, wherein the base member has a longitudinal axis, and the rotational axis of the roller frame extends at an angle within the range of 20 degrees to 80 degrees relative to the longitudinal axis of the base member.

18. The paint roller of claim 16 wherein the rotational axis of the roller frame extends at an approximately 30 degree angle relative to the longitudinal axis of the base member.

19. The paint roller of claim 16, wherein rotation of the roller frame about the rotational axis causes the roller cage to rotate within a plane that intersects the longitudinal axis of the base member.

20. A paint roller, comprising:

a base member, a mount on the base member, a roller frame haying a first end for rotatably mounting a roller cage and a second end for rotatably mounting the roller frame to the mount for rotation of the roller frame about a rotational axis, and a spring tension assembly interengaging the mount and the second end of the roller frame for adjustably tensioning a resistance force applied against rotation of the roller frame about the rotational axis, wherein the spring tension assembly includes a rotatable adjustment member that, when rotated, adjusts the resistance force applied by the spring tension assembly against rotation of the roller frame; and a lock for releasably locking the roller frame in selected positions of rotation about the rotational axis, wherein the lock includes a locking member rotatable between a first position that permits the roller frame to rotate about the axis of rotation, and a second position that locks the roller frame in a selected position of rotation about the rotational axis, the locking member having a first detent with a first depth and a second detent with a second depth that is less than the first depth, and wherein the lock further comprises a tab on the mount for selectively engaging the first and second detent members upon rotation of the locking means between the first and second positions.

21. The paint roller of claim 20, wherein when the locking member is rotated to the first position the tab engages the first detent, and when the locking member is rotated to the second position the tab engages the second detent.

* * * * *